United States Patent [19]

Kageyama et al.

[11] Patent Number: 4,872,776

[45] Date of Patent: Oct. 10, 1989

[54] LEAD CHUCK OF MECHANICAL PENCIL

[75] Inventors: Hidehei Kageyama; Yoshihide Mitsuya; Yoichi Nakazato, all of Kawagoe, Japan

[73] Assignee: Kotobuki & Co., Ltd., Kyoto, Japan

[21] Appl. No.: 114,745

[22] Filed: Oct. 30, 1987

[30] Foreign Application Priority Data

| | | | |
|---|---|---|---|
| Oct. 30, 1986 | [JP] | Japan | 61-167356[U] |
| Jun. 30, 1987 | [JP] | Japan | 62-100526[U] |
| Sep. 17, 1987 | [JP] | Japan | 62-140862[U] |

[51] Int. Cl.[4] ..... B43K 21/22

[52] U.S. Cl. ..... 401/65; 401/67; 401/93; 401/94

[58] Field of Search ..... 401/53, 65, 67, 92–94

[56] References Cited

U.S. PATENT DOCUMENTS

| | | | |
|---|---|---|---|
| 1,296,011 | 3/1919 | Roll | 401/93 |
| 1,724,412 | 8/1929 | Pollak | 401/67 |
| 2,801,613 | 8/1957 | Gigli | 401/93 |
| 4,571,105 | 2/1986 | Sekiguchi | 401/65 |
| 4,729,684 | 3/1988 | Sakaoka | 401/67 X |

FOREIGN PATENT DOCUMENTS

| | | | |
|---|---|---|---|
| 0088318 | 9/1983 | European Pat. Off. | 401/53 |
| 2260065 | 6/1974 | Fed. Rep. of Germany | 401/67 |
| 3336959 | 4/1985 | Fed. Rep. of Germany | 401/65 |

*Primary Examiner*—Richard J. Apley
*Assistant Examiner*—Franklin L. Gubernick
*Attorney, Agent, or Firm*—Sherman and Shalloway

[57] ABSTRACT

A lead chuck of a mechanical pencil to be assembled into a lead feeding mechanism of a rear end knock type, an automatic lead feeding type and an extremity end knock type mechanical pencil in which it is arranged within the sleeve through a resilient member in such a way as it may be advanced or retracted. A lead holding part is formed at the extremity end portions of the divided surfaces of the chuck members which are fully divided into two sections along an axial plane. The lead holding part is formed with several teeth for use in holding the lead under four-point or six-point contacted condition within axially formed grooves made at the central portions of the divided surfaces. The teeth are projected in several rows and formed at the raised surfaces of the grooves. Stepped partial circumferential projections are projected and formed at the central part of the raised parts of the front portions of the semi-circumferential flange which are projected and formed at the outer circumference at the rear ends of the chuck members. Other stepped projections are formed at both end portions of the raised rear surfaces of the opposite sides of the flange, thereby the extremity end of the lead supplying cylinder extremity end receiving element is abutted against the rear raised surface of the flange part from the rear end side of the lead chuck. Forces applied from both directions, when the front raised surface of the flange part receive the rear end of the resilient member installed between it and the sleeve, are utilized and each of the chuck members generates a flexing phenomenon and the chuck members may then perform an instantaneous expanding operation under this flexing force.

9 Claims, 12 Drawing Sheets

LEAD CHUCK OF MECHANICAL PENCIL

BACKGROUND OF THE INVENTION

1. Field Of The Invention

This invention relates to a lead chuck constituting a lead feeding mechanism of a mechanical pencil, and more particularly a lead chuck of a mechanical pencil in which a relative sliding between a lead holding part of the lead chuck and an outer circumference of a lead is prevented, a biting action against the lead is positively performed, and even if an outer circumference of the lead is scraped by the lead holding part, the biting against the lead is positively performed and at the same time a clogging caused by lead dust or the like is prevented.

2. Description Of The Prior Art

In general, a lead chuck of a mechanical pencil is installed between a lead pipe arranged at a rear end of a shaft and a slider arranged at an extremity end of the shaft. The lead chuck is constructed such that it is equally divided into three portions by axial slots formed at the extremity end. These chuck pieces are merely formed by three repetitive cuts or by injection molding a complex mold so as to make a lead chuck.

The above-mentioned lead chuck with a three-way divided end shows a reduction in its productivity and has a substantial start-up cost due to the fact that its manufacturing method is complicated as described above. Since the mere forming of a three-way divided lead holding part with slots fails to provide sufficient lead holding force, it is sometimes found that a toothed part having some lead biting teeth is required. However, forming of such teeth causes a complex shape and structure of the lead chuck in addition to the above-mentioned structure. Thus, in such a case, after the slot forming operation is carried out, the teeth must be formed by a tapping operation or the like, resulting in a substantially deteriorated efficiency of manufacture.

In view of the foregoing, it is proposed by the present applicant to provide a lead chuck of a two-way divided fully separate structure in place of the above-mentioned lead chuck of three-way divided structure with a slotted extremity end.

The lead chuck of this two-way divided fully separate type is constructed such that the two chuck members are formed as a small cylindrical cylinder axially divided into two separate portions which have approximately similar shapes and are integrally assembled in a way such that their divided surfaces contact each other so as to hold a lead therein. In order to hold the lead, the divided surfaces of the above-mentioned chuck members are formed with a lead insertion hole along their axial directions at a substantially central part, and at the extremity ends of these chuck members are formed small diameter lead holding holes. Each of the outer circumferences of the chuck members is provided with a ball holding part to secure balls therein as they are guided by an inner circumferential tapered surface of the chuck fastening member at the extremity end to fasten and hold the chuck member. At the rear end, each of the resilient means engaging flanges is formed in a semi-circumferential shape for resiliently biasing against the sleeve. At the divided surfaces, positioned to correspond to the semi-circumferential flanges, are formed some supporting points for use in expanding or retracting each of the chuck members of the lead chucks in a forward or rearward direction. Further, at each of the rear end portions of the chuck members is formed an outer circumferential tapered surface for use in expanding an extremity end of the chuck member when the rear end of the chuck member is pushed out in a rearward direction by knocking against a knocking part which is projected and arranged at an axial rear end of the mechanical pencil.

By use of a two-way divided fully separate type lead chuck constructed as described above, it is possible to eliminate disadvantages such as a reduction in productivity or an increased cost of manufacturing or the like, during formation of the lead holding teeth even when the chuck member is to be formed by injection molding or the like. Use of this type of chuck assures ease of manufacture and that the lead holding force of the lead holding teeth will be sufficient.

However, even if the above-mentioned conventional type of lead chuck of a mechanical pencil is used, a so-called lead diameter reducing phenomenon occurs in which teeth formed at the lead holding part on each of the chuck portions cuts into an outer circumference of the lead as the mechanical pencil is used in. This occurs even though the intent is to provide a positive holding of the lead by formation of the teeth, and thus the lead holding force is gradually decreased and sliding of the lead may occur.

The above-mentioned lead chuck is for use in a mechanical pencil of a rear end knock type. A mechanical pencil of the automatic knock type has means by which a pressing of the extremity end of the lead against the surface of a writing paper causes the lead to be automatically fed when the writing pressure is released during a writing operation. A mechanical pencil of extremity end knock type used together with this automatic lead feeding feature or by itself has had the problem of a lack of projection amount of the lead. An outer circumference of the lead is cut by the teeth of the lead chuck divided surfaces, thus causing the lead to be further reduced in its diameter which, in turn, causes a reduction in holding force. Different amounts of holding force are required during the pressing of the pencil against the writing sheet and during its released state.

This lead diameter reduction phenomenon causes lead dust to be accumulated in a clearance of the lead insertion hole of the lead chuck or in another clearance between the lead chuck and the sleeve or the like and results in various lead feeding operations such as a rear end knock, automatic lead feed and extremity end knock or the like to be delayed due to clogging of the lead dust. The operating characteristics are deteriorated and in the worst state, the lead feeding function is not operable at all.

SUMMARY OF THE INVENTION

This invention has been invented in order to resolve the above-mentioned problems and establishes the following objects.

It is a first object of the present invention to provide a lead chuck of a mechanical pencil in which lead holding teeth of a lead chuck are constructed such that a large portion of the outer circumferential part of the lead is held in the teeth. A cutting of the outer circumference of the lead, with the teeth formed at the lead holding part at each of the extremity ends of the chuck part, does not occur even during use of the mechanical pencil for long periods. Thus, a so-called reduction in the diameter of lead can be prevented, sliding of the lead does not occur and the lead holding teeth have a superior lead holding force.

It is a second object of the present invention to provide a lead chuck for a mechanical pencil in which the above-mentioned phenomenon of reducing diameter of a lead can be prevented even in the case of a lead chuck which requires an especially strong lead holding force as found in an automatic lead feeding mechanical pencil or an extremity end knock type mechanical pencil as well as in a rear end knock type mechanical pencil. Further, a positive lead feeding characteristic in these automatic or semi-automatic mechanical pencils, as well as a smooth writing caused by difficulty in breaking of the lead, can be promoted.

It is a third object of the present invention to provide a lead chuck for a mechanical pencil which prevents diameter reduction of a lead due to cutting by the teeth formed on the above-mentioned lead holding surface. Thereby, lead dust does not clog the lead insertion hole of the lead chuck or between the lead chuck and the sleeve so that various lead feeding operations such as a rear end knock, an automatic lead feeding and an extremity end knock or the like can be smoothly performed, and at the same time occurrence of troubles in these lead feeding mechanisms can be reduced or completely eliminated.

It is a fourth object of the present invention to provide a lead chuck for a mechanical pencil in which an expanding operation of the lead chuck for releasing a held lead is performed positively, smoothly and rapidly due to stepped projections formed at an approximate displacement of 90° at a semi-circumferential flange arranged to correspond to the supporting points positioned at the divided surfaces of the chuck, and due to expanding flexing force applied by the extremity end of the stopper upon abutment against the projections at the rear end of the flange. Thereby, some disadvantages such as the above-mentioned lead diameter reducing phenomenon and the phenomenon of clogging of lead dust are resolved, and the lead holding teeth and the operating characteristic of the lead holding teeth can be improved.

A lead chuck of a mechanical pencil of the present invention for accomplishing each of the above-mentioned objects is constructed such that the teeth formed at the holding part at an extremity end of the divided surfaces of the chuck part are contacted by an outer circumference of a lead at four points or six points. The chuck is made in such a way that the teeth are alternatively staggered and the stepped projections are spaced circumferentially by about 90° at the extremity end and a rear end of the semi-circumferential flange which is arranged on the outer circumference of the chick at about the same axial location as the expanding supporting points.

BRIEF DESCRIPTION OF THE DRAWING FIGURES

DETAILED DESCRIPTION OF THE INVENTION

Figure 1:
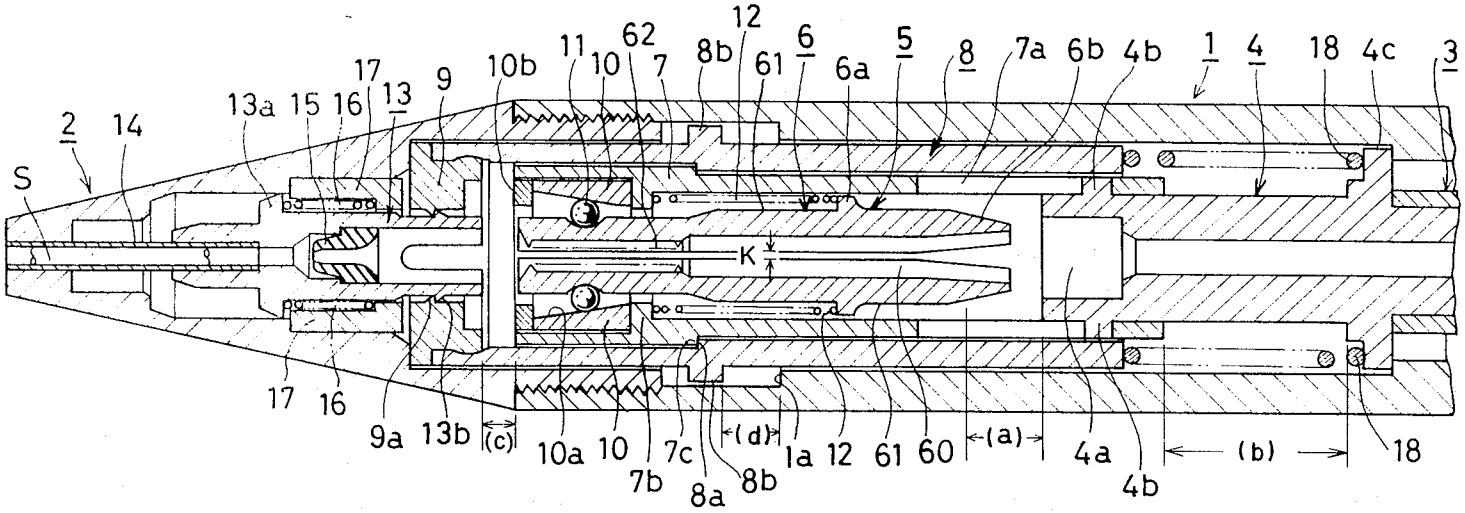
FIG. 1 is a schematic section for showing a first preferred embodiment of a lead chuck of a mechanical pencil of the present invention.

Referring now to the drawings, some preferred embodiments of the lead chuck of the mechanical pencil of the present invention will be described in detail.

FIGS. 1 to 10 illustrate a first preferred embodiment, wherein the lead chuck of the preferred embodiment is, as illustrated in FIG. 1, arranged at an extremity end of an outer cylinder 1 of the mechanical pencil. To the extremity end of the outer cylinder 1 is threadably engaged a tip element 2, and within a part near the extremity end of the outer cylinder 1 is arranged a lead supplying cylinder 3 which can be slid in an axially forward direction. To the extremity end of the lead supplying cylinder 3 is fitted an extremity end receiving element 4, and to the extremity end of the extremity end receiving element 4 is arranged a lead feeding mechanism 5 with a spacing of an inter-contact distance (a). The extremity end receiving element 4 pushes a lead chuck 6 (to be described later) and has an extremity end hole 4*a* to be engaged with the chuck. The lead chuck is slidably stored in a substantially cylindrical sleeve 7, and a part 4*b*, projected and formed at any location of an outer circumferential part of the extremity end hole 4*a* of the extremity end receiving element 4, is slidably fitted into a longitudinally extending guide groove 7*a* punched axially at a rear end of the sleeve 7.

The lead feeding mechanism 5 is substantially composed of a two-way divided fully separate type lead chuck 6, a sleeve 7 having the lead chuck installed therein and its rear end slidably engaged with the extremity end of the extremity end receiving element 4, an intermediate frame 8 arranged at an outer circumference of the sleeve 7 and slidably holding the sleeve 7, a front cylinder 9 fitted to the extremity end of the intermediate frame 8, a chuck fastening element 10 for use in fastening the extremity end of lead chuck 6 within a limited circumferential area, fastening balls 11 installed between an inner circumferential tapered surface 10*a* of the chuck fastening element 10 and the lead chuck 6, and a first resilient body 12 installed between a flange part 7*b* formed at an inner circumferential surface at the front end of the sleeve 7 and an engaging stepped part 6*a* formed as a semi-circumferential flange projected and formed at an outer circumference at a rear end of the lead chuck 6, for biasing the lead chuck rearwardly. The sleeve 7 and the intermediate frame 8 are disposed in such a way that the sleeve 7 may slide axially within the intermediate frame 8 while the rearward movement of the sleeve 7 is being limited by the large diameter circumferential stepped part 7*c* of the sleeve 7 and the large diameter inner circumferential stepped part 8*a* of the intermediate frame 8. The outer circumferential side of the intermediate frame 8 is provided with sliding guide projections 8*b*, for example, at two locations of opposing outer circumferential surfaces. These projections 8*b* are slidably fitted to a guide groove la formed at a corresponding position of the inner circumferential surface of the outer cylinder 1 acting as a shaft of the mechanical pencil. Further, the front end side of the chuck fastening element 10 is provided with a ball receiving portion 10*b* for use in preventing balls 11 from being disengaged from a space between the tapered surface 10*a* and the chuck member 6.

The structure of the mechanical pencil at its extremity end is such that the extremity end of the intermediate frame 8 is stored in such a way as it may be advanced or retracted from the extremity end of the outer cylinder 1 to within the tip element 2. The slider 13 is arranged at the far extremity end of the intermediate frame 8 in such a way that the slider can be slid axially within the tip element 2. A lead pipe 14 is integrally assembled within the extremity end of slider 13. The rear end part of slider 13 has a central rear opening part which has provided within it a friction applying member 15 such as a packing or the like having a specified friction between it and the slider 13 so as to apply the specified friction force to the lead S during lead feeding operation. To the outer circumference of the slider 13 is fixed a second resilient member 16 for always biasing the slider 13 in a forward direction. A spring receiver 17 engaged with the rear end part of the second resilient member 16 is fixed to an inner circumferential surface of the tip element 2. The extremity end of the second resilient member 16 is engaged with a large diameter outer circumferential stepped part 13*a* of the slider 13, and the outer circumferential surface of the rear end of the slider 13 has a temporary engaging projection 13*b* temporarily causing the slider 13 to be engaged with the engaging projection 9*a* projected and formed at the inner circumferential surface of the front cylinder 9.

Structure at a central part of the mechanical pencil, i.e. a rear end of the lead feeding mechanism 5, is made such that a third resilient member 18 is installed between a flange 4*c* circumferentially projected and formed at an outer circumference of the rear end of the receiving element 4 and a rear end surface of the intermediate frame 8. The rear end of the receiving element is fixed to the extremity end of the lead supplying cylinder. As regards the positional relation of each of the members along an axial direction of the lead feeding mechanism 5, the following relation can be found in addition to the clearance (a) between the extremity end surface of the receiving element 4 and the desired part of the rear tapered cylindrical part 6*b* at the rear end of the lead chuck 6 to be described later. At first, as shown in FIG. 1, a clearance (b) is arranged between the flange 4*c* of the receiving element 4 and the rear end surface of the sleeve 7, a clearance (c) is arranged between the extremity end surface of the sleeve 7 and the rear end surface of the front cylinder 9 arranged in the intermediate frame 8, and a clearance (d) is arranged at a guide groove 1*a* of the outer cylinder 1 in such a way as the sliding guide projection 8*b* of the intermediate frame 8 can be axially advanced or retracted.

Figure 2:
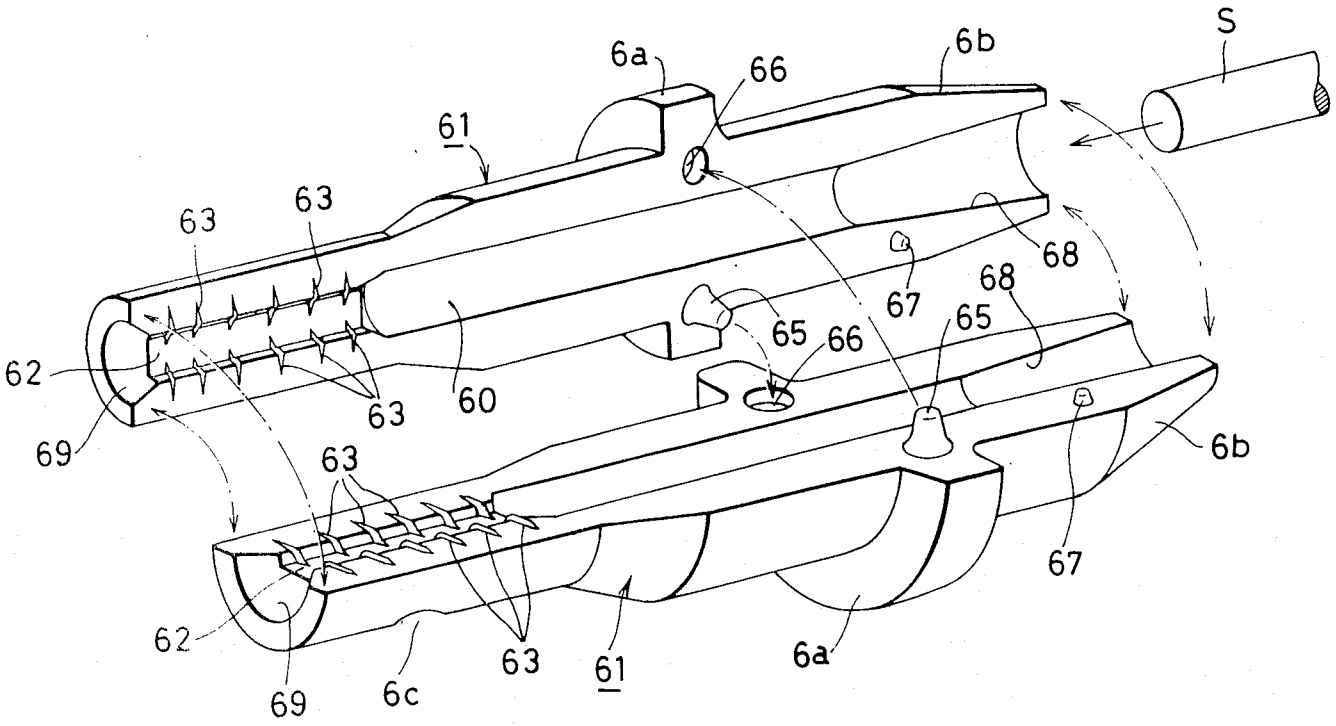
FIG. 2 is an enlarged development perspective view for showing a lead chuck of a first preferred embodiment of FIG. 1.
Figure 3:
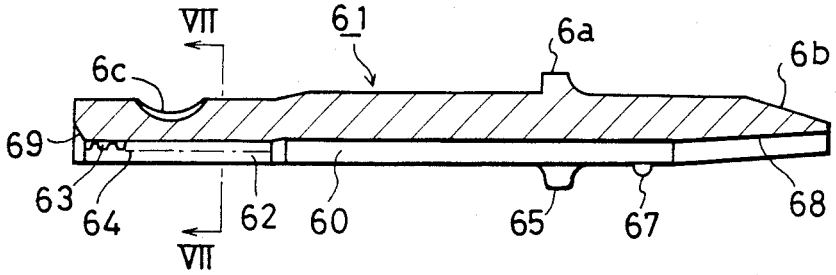
FIG. 3 is also a section for showing a lead chuck of a first preferred embodiment of FIG. 1.
Figure 4:
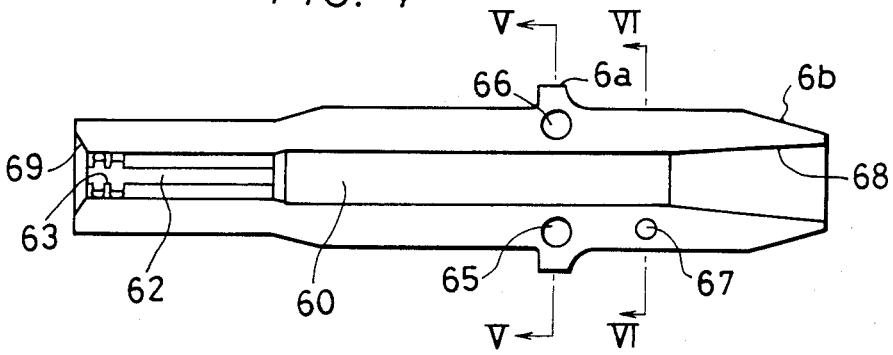
FIG. 4 is also a top plan view for showing a lead chuck of a first preferred embodiment.
Figure 5:
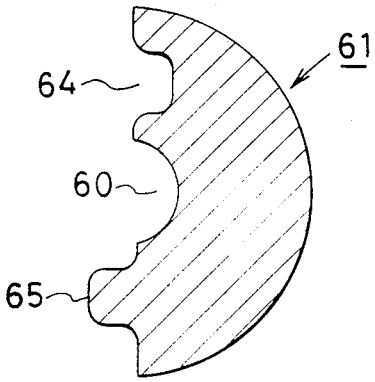
FIG. 5 is a section taken along a line V—V of FIG. 4.
Figure 6:
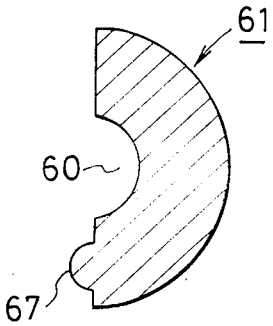
FIG. 6 is a section taken along a line VI—VI of FIG. 4.
Figure 7:
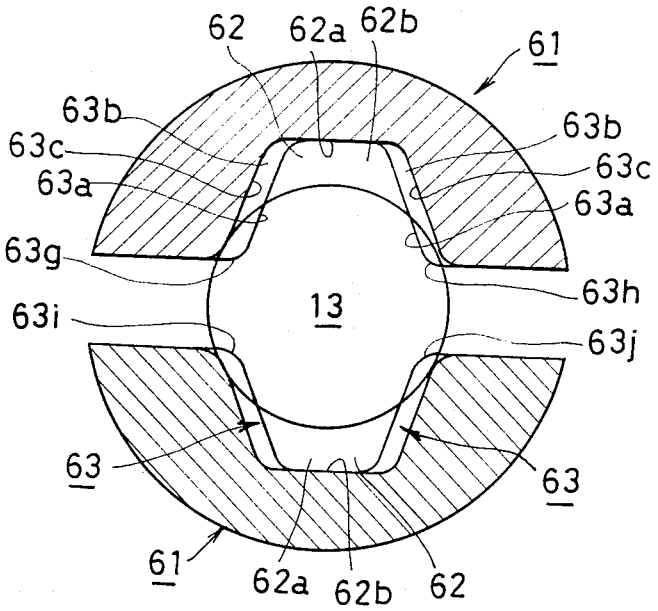
FIG. 7 is a section taken along a line VII—VII of FIG. 3 for illustrating a lead holding condition of a lead holding part.
Figure 8:
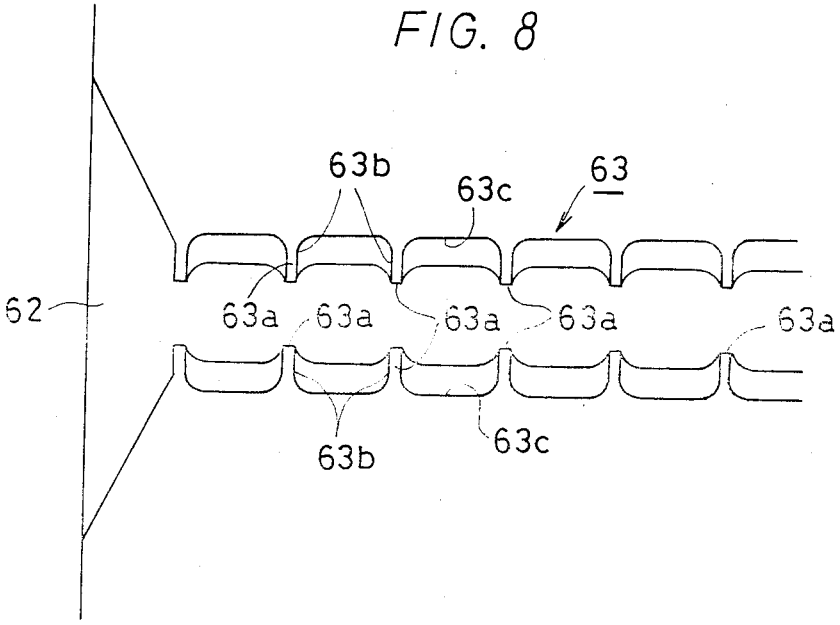
FIG. 8 is a top plan view for showing one of the chucks of FIG. 7 in a partially enlarged state.
Figure 9:
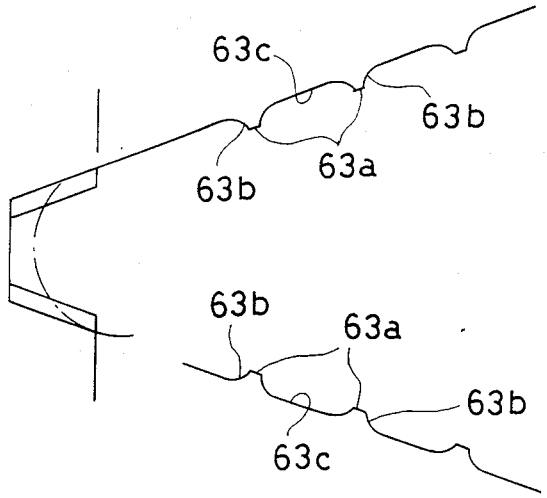
FIG. 9 is a partial enlarged development view for showing a lead holding part of FIG. 7.
Figure 10:
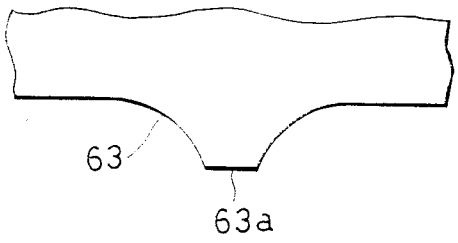
FIG. 10 is an enlarged view for showing the teeth of FIG. 9.

Then, one of the most important features of the present invention, i.e. a detailed constitution of the lead chuck in the lead feeding mechanism 5, will be described. The lead chuck 6 is made of a metallic product formed by a forging or pressing operation, of a sintered alloy by a die-casting operation, or of a synthetic resin formed product molded by an injection molding, press molding or the like. Details of the lead chuck 6 are such that as shown in FIG. 2, the chuck is divided into two chuck members 61 and 61 in a longitudinal direction along an axis of the lead S insertion hole 60. The chuck member 61 has the flange 6*a* semi-circumferentially projected and formed at its outer circumference, a rearwardly tapered cylindrical part 6*b* extending rearwardly from the flange 6*a*, and a ball holding part 6*c* for setting positions of the balls 10 held against the lead chuck fastening element 9. At the junction surfaces of the chuck members 61 and 61 is formed a lead holding part 62 at the front end of the chuck member 61 adjacent with the lead insertion hole 60. The lead holding part 62 is formed with teeth 63 which are continuously but spacedly formed along the axial direction of the lead holding part. Junction surfaces of the chuck members 61 are further provided with, at the location corresponding to the flange 6*a*, projections 65 and 65. Concave portions 66 and 66 are formed at positions opposite their corresponding projections 65, 65 so as to cause the projections 65 and 65 to be fitted therein, and opening or closing supporting point projections 67 and 67 projected and formed in parallel with the projections 65 and 65 are formed so as to provide spacing apart of the relative junction surfaces of the chuck members by a specified distance. The rear end of the lead insertion hole 60 is expanded rearwardly to form tapered lead guides 68 and 68, and the front ends of the lead holding parts 62 and 62 are expanded in a forward direction to form tapered portions 69 and 69. Since the projections 65 and the concave portions 66 are arranged at each of the symmetrical positions of the junction surfaces, it is possible to prevent the positions of the chuck members 61 and 61 from being displaced from their desired positions when the divided surface of one member 61 is opposite to the divided surface of the other member 61. Although the opening or closing point projections 67 may act as a spacer for assuring a clearance K in FIG. 1, a setting of heights of both projections 65 and 65 slightly larger than a depth of both concave portions 66 and 66 results in the projections 65 and 65 acting as spacers even if the projections 66 are eliminated.

The lead holding portions 62 are rectangular flat concave portions arranged at a front end of the lead chuck, and the teeth 63 are constructed such that the lead S is supported at four circumferential points when the chuck members 61 and 61 are closely adjacent to each other. Detailed construction of the teeth 63 will be described in reference to FIGS. 2 and 7–10.

That is, the lead holding part 62 is formed to have a substantially U-shaped cross-section. Both inner surfaces of the lead holding part 62 are formed integrally with a plurality of cogs of the teeth 63 which are spaced along an axial direction thereof.

These cogs of the teeth 63, as shown in FIGS. 8 to 12, have a raised surface **63*b* which is gradually tapered to form an acute shape, and each of the extremity end surfaces 63*a* is truncated to form a narrow flat surface. Each of the groove bottoms 63*c* of the teeth 63 is also formed as a flat shape. The teeth 63 form lead supporting portions 63*g* to 63*j* for supporting an outer circumference of the lead S at four points. These lead supporting portions 63*g* to 63*j* may support the lead S at four points in a line contacting state. A sufficient lead biting force can be attained and a proper lead holding is carried out by the lead supporting parts 63*g* to 63*j* formed by the teeth 63. As described above, the lead holding part 62 is formed to have a substantially U-shaped section, and a bottom part of the lead holding part 62 is formed without the teeth 63 so as to keep a space for the lead dust discharging part 62*b*. Therefore, since the lead dust or the like is discharged through the lead dust discharging part 62*b***, the amount of lead dust accumulation remains low, and even if the lead dust does begin to accumulate, the lead dust or the like is automatically discharged as the lead is moved during its feeding operation. Therefore, the present invention provides an excellent feature whereby the sliding of the lead does not occur during writing.

A lead feeding operation of the present invention will now be described. The lead feeding operation can be classified into two categories.

(1) At first, a first lead feeding operation is performed in a normal manner with a rear end knock of the lead supplying cylinder 3.

That is, the sleeve 7 engaged with the extremity end receiving element 4 is advanced together with the lead supplying cylinder 3 or the like under a knocking operation [a spacing of a distance (c)], feeds the lead until it abuts against the rear end of the front cylinder 9, and thereafter is stopped.

That is, (A) in the case where the slider 13 is not locked with the front cylinder 9, a normal lead feeding operation is carried out by the rear end knocking operation.

(B) In turn, in the case where the slider 13 is locked with the front cylinder 9 under engagement between the inner wall annular projection **9*a* and an outward projection 13*b* (see FIG. 1), the lead is fed in the same manner as that of (A) until the extremity end of the sleeve 7 is abutted against the rear end of the front cylinder 9 under the above-mentioned rear end knocking operation. Thereafter, the slider 13 is pushed forwardly by advancement of the lead chuck 6. With this arrangement, the outward directed projection 13*b* of the slider 13 rides over the inner wall annular projection 9*a* of the front cylinder 9 and then the locked condition is released. Thereafter, the slider 13 is biased and moved in a forward direction by the second resilient body 16, and the slide pipe 14 is projected out of the tip element 2. During this process, the lead S supported by a retracting frictional force of the friction applying member 15 is pulled out of the lead chuck 6 in a forward direction and is advanced together with the slider 13**.

Therefore, the lead S is always projected by a distance (c) from the extremity end of the slider pipe 14, which is appropriate for writing action. As described above, both a lock releasing action and a lead feeding operation can be performed simultaneously such that the lead S is projected only by a distance (c) which is appropriate for writing operation.

Therefore, it becomes possible to perform a writing operation while the projection amount of the lead S is confirmed with bare eyes.

(2) As a second lead feeding operation, an automatic lead feeding operation can be carried out after the writing action is interrupted.

That is, the writing operation is normally performed while the lead S is projected from the slider pipe 14 by a desired amount. Then, the lead S is worn out in sequence as the writing action is promoted, and finally becomes flush with an extremity end of the slider pipe 14. Even under this condition, the slider 13 may retract as much as possible against a biasing force of the second resilient body 16 to the rear end by a distance in which the inner wall annular projection **9*a* is engaged with the outward projection 13*b*. Therefore, a longer period of continuous writing is required before an amount of worn-out lead S becomes equal to a retracted distance. For example, in the case of the mechanical pencil with a 0.5 mm diameter HB lead under a normal writing pressure of an adult person, an amount of worn-out lead during writing of one Chinese character on a high quality paper is merely about 0.01 mm. Therefore, a continuous writing until the slider 13 is retracted by a retracting distance will not normally be performed before the writing is interrupted for a rest from writing. So, for example, it is assumed that the writing action is interrupted and the extremity end of the slider pipe 14 is removed from the paper sheet. With this action, the slider 13 is advanced by a resilient force of the second resilient body 16, and the lead S is pulled in an advancing direction from the friction applying member 15 under the desired frictional force together with the slider 13**.

In turn, since the chuck fastening force of the lead chuck 6 biting the lead S is applied by the first resilient body 12 which is weaker than the second resilient body 16, the first resilient body 12 is compressed with a pulling force in an advancing direction of the above-mentioned lead S to allow for an advancement of the entire lead chuck 6. During this advancement, the head part of the lead chuck 6 is operated such that as the balls 11 rotate and advance while contacting with the inner surface of tapered wall 10*a* of the fastening element 10 arranged at the extremity end of the sleeve 7, a biting force of the lead chuck is gradually decreased and the feeding of the lead S is carried out. After this operation, the lead chuck is returned again to its retracted condition in preparation for performing a further automatic lead feeding operation to enable a writing operation to be performed so that a continuous writing up to the maximum retracting distance can be carried out.

The case of non-use of the writing instrument will now be described. A rear end of the lead supplying cylinder 3 is knocked from a condition in which the slider 13 is not locked with the front cylinder 9 and the slider pipe 14 is pushed against the paper sheet or the like, thereby the slider pipe 14 is completely stored in the tip element 2 and locked therein. That is, when the slider pipe 14 is pushed against the paper sheet or the like while the rear end of the lead supplying cylinder 3 is being knocked, the slider 13 is retracted together with the slider pipe 14. With this arrangement, as the slider pipe 14 is stored completely in the tip element 2, the outer projection 13*b* of the slider 13 rides over the inner wall annular projection 9*a* of the front cylinder 9 in its retracting direction and the outward projection 13*b* becomes engaged with the inner wall annular projection 9*a*. Thereby the slider pipe 14 is stored and locked completely in the tip element 2.

This cocked condition will not be released as long as the rear end of the lead supplying cylinder 3 is not knocked.

Figure 11:
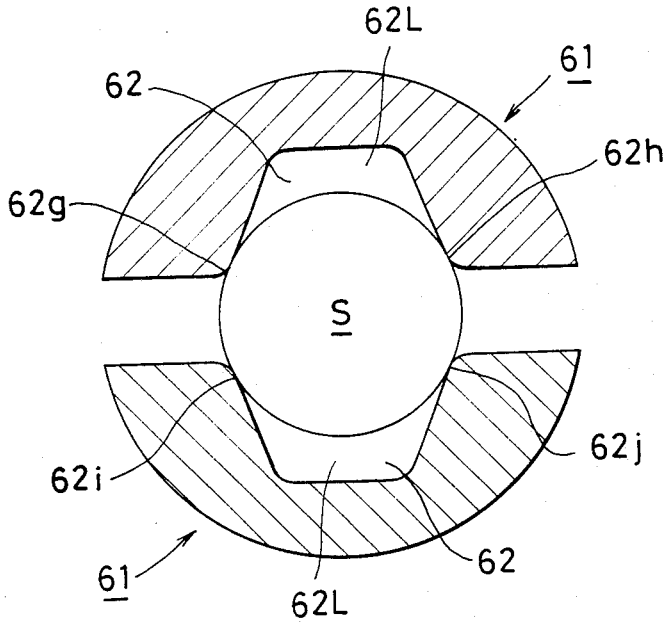
FIG. 11 illustrates a second preferred embodiment of a lead chuck for a mechanical pencil of the present invention and is an enlarged section for showing a different shape of the teeth.
Figure 12:
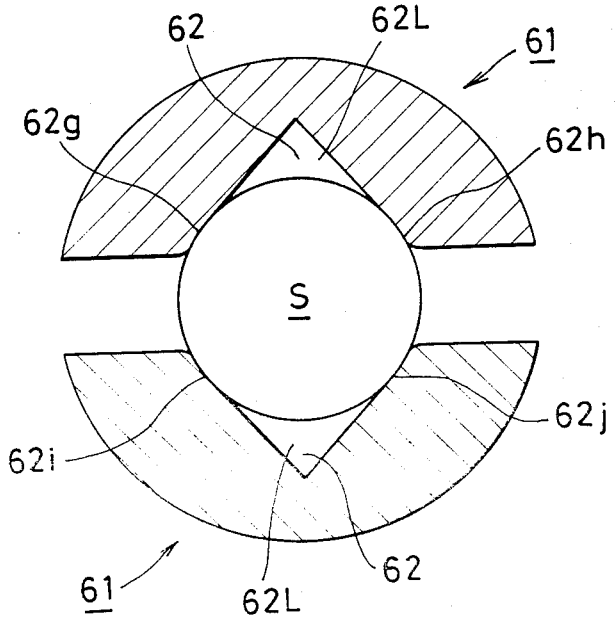
FIG. 12 illustrates a third preferred embodiment of a lead chuck for a mechanical pencil of the present invention and is an enlarged section for showing a different shape of the teeth.

FIGS. 11 and 12 illustrate second and third preferred embodiments of the chuck members 61 and 61, respectively.

In the second preferred embodiment shown in FIG. 11, the teeth 63 of the lead holding part 62 in the first preferred embodiment are removed, and both released ends of the lead holding hole 62 are applied to the lead S as lead holding parts 62*g* to 62*j*. Also in this preferred embodiment, the lead holding hole 62 is formed to have a substantially U-shaped section, a lead dust discharging part 62L is arranged to enable an effective discharging of the lead dust to be performed. Also in the third preferred embodiment shown in FIG. 12, the teeth 63 of the lead holding part 62 are removed and both sides of the released end of the lead holding hole 62 are applied to the lead S as the lead supporting parts 62*g* to 62*j*. The lead holding hole 62 is formed as a U-shaped section and lead dust discharging part 62L is arranged.

In this way, even in case of the lead holding hole 62 shown in FIGS. 11 and 12, a substantially similar effect to that of the first preferred embodiment can be obtained.

The lead holding hole 62 described in each of the first to third preferred embodiments may have other cross-sectional shapes so long as the hole is supported by four points as described above.

A fourth preferred embodiment of the present invention will be described in reference to FIGS. 13 to 23. The fourth preferred embodiment corresponds to the case in which the outer circumferences of the lead S in the first to third preferred embodiments is supported by the teeth 63 at four points with the lead holding part 62. The fourth preferred embodiment has an advantage in that the outer circumference of lead S is held at six points so that a sliding of the lead is not generated within the lead holding part 62 when the lead S is in a reduced state. In the fourth preferred embodiment, the extremity end receiving element for pushing the lead chuck in a forward direction is provided with a resilient stepped part to enable an instantaneous expansion of the lead chuck at a location where it is abutted against the lead chuck.

Figure 13:
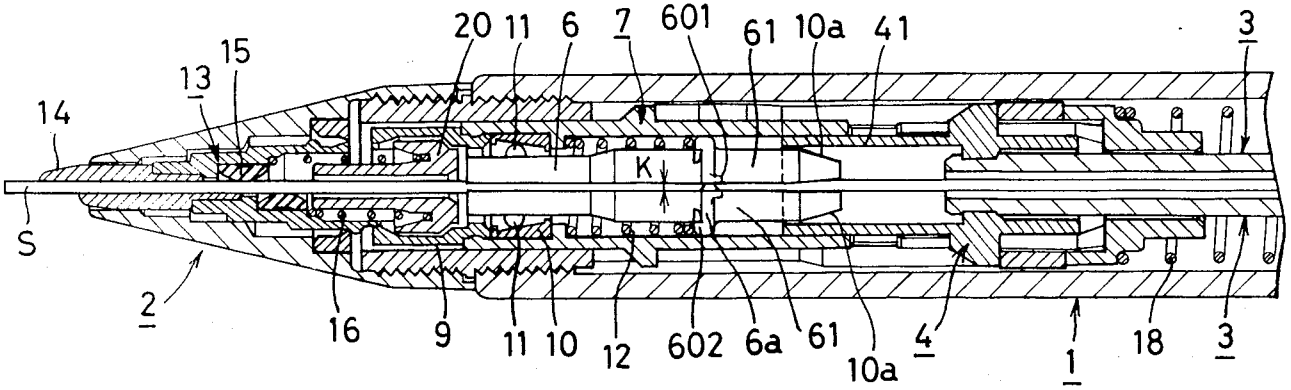
FIG. 13 illustrates a fourth preferred embodiment of a lead chuck of a mechanical pencil of the present invention and is an entire section for showing an assembled condition of the lead chuck into the mechanical pencil having a stepped expanding projection at a semi-circumferential flange of the chuck member.
Figure 14:
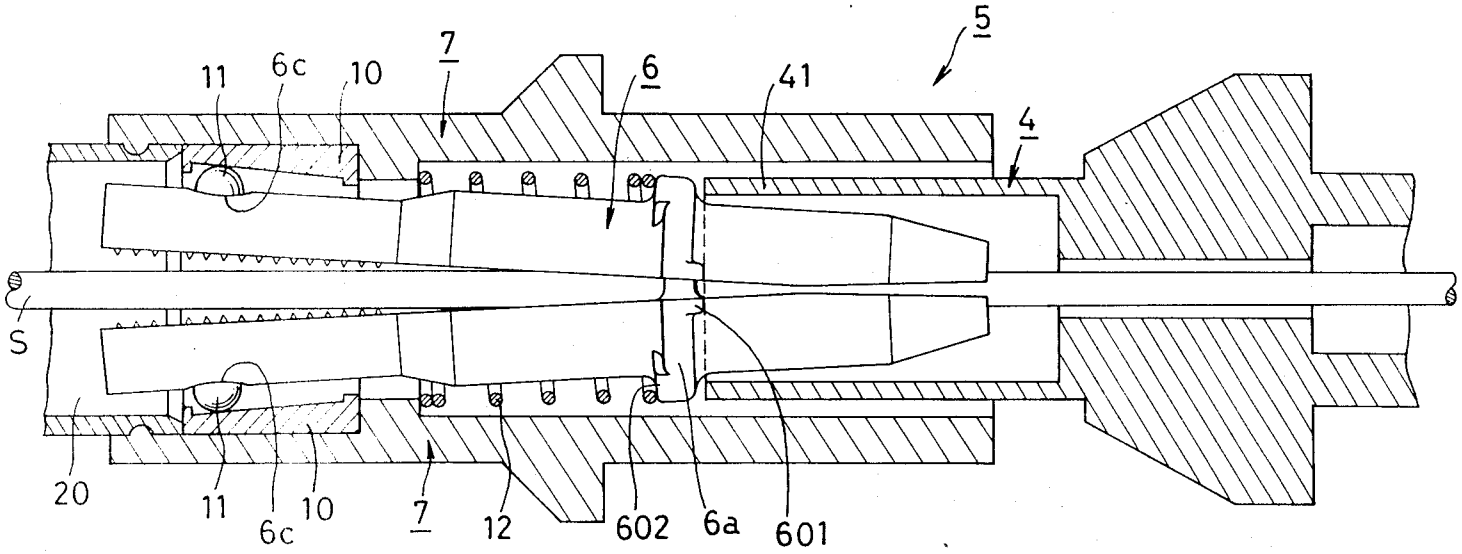
FIG. 14 is an enlarged front elevational view partly in section for showing the lead chuck of a fourth preferred embodiment together with the sleeve and the stopper.
Figure 15:
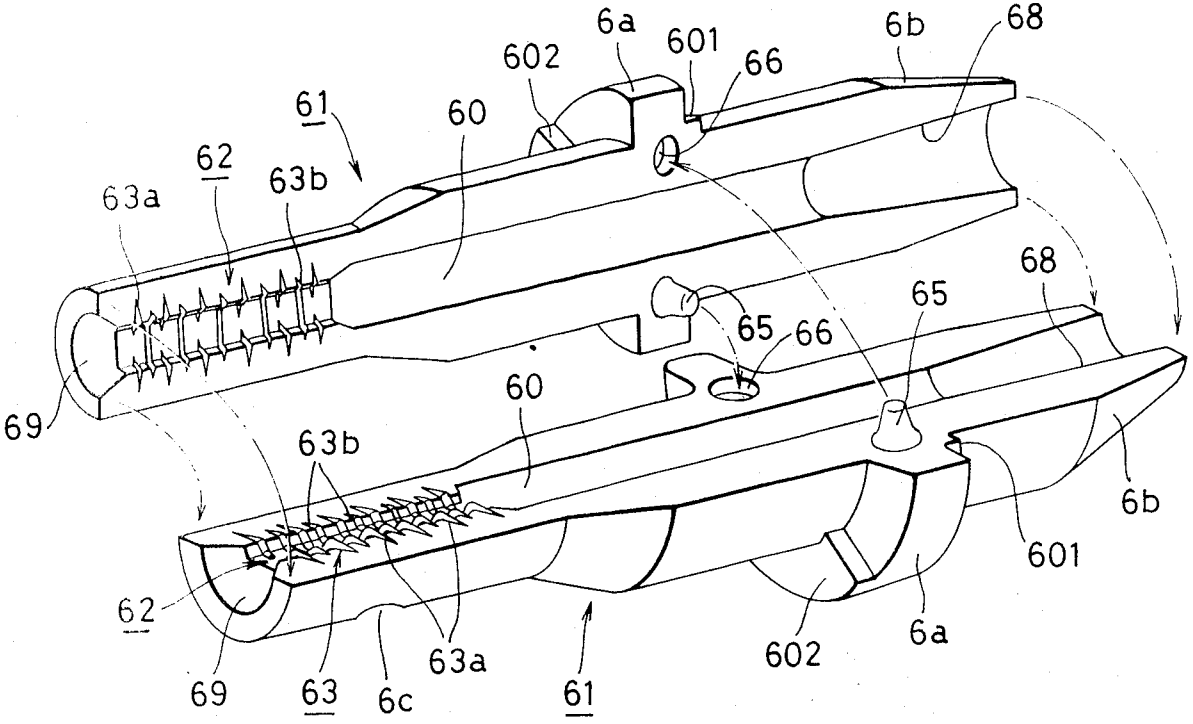
FIG. 15 is also an enlarged development perspective view for showing a face-to-face condition of the chuck member of a fourth preferred embodiment.
Figure 16:
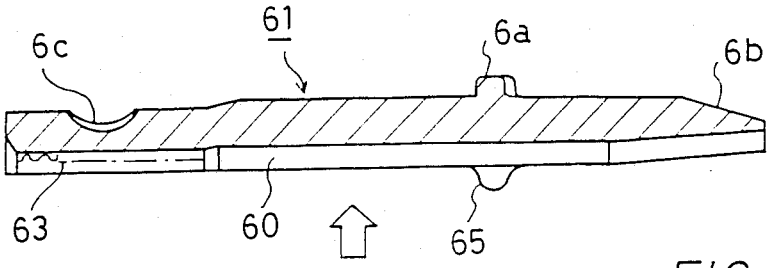
FIG. 16 is a section for showing the chuck member of a fourth preferred embodiment.
Figure 17:
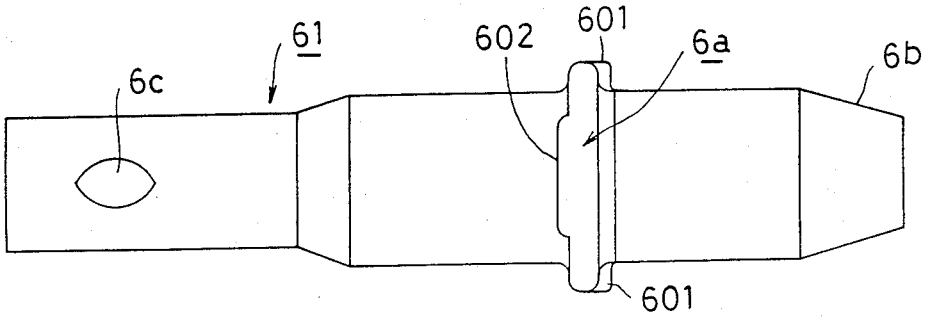
FIG. 17 is also a top plan view for showing the chuck member.
Figure 18:
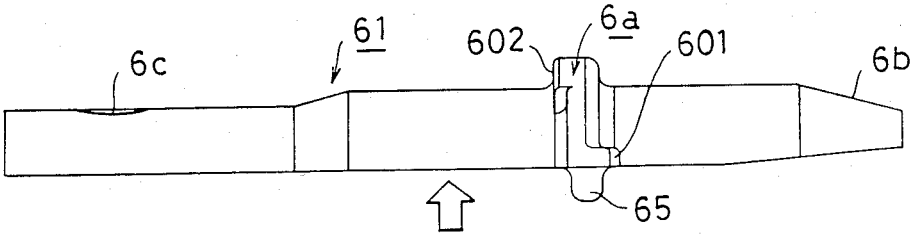
FIG. 18 is also a front elevational view for showing a chuck member.
Figure 19:
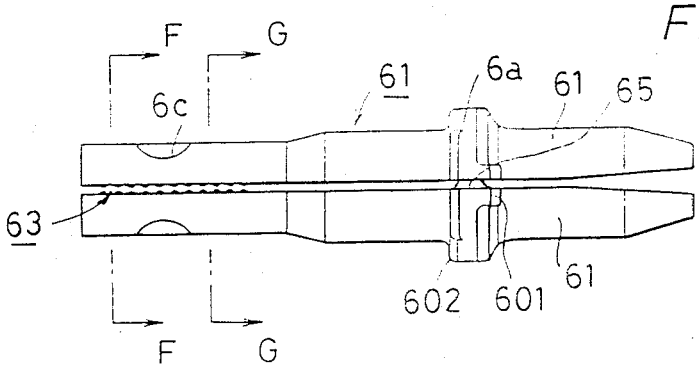
FIG. 19 is a front elevational view for showing an assembled condition of the lead chuck.

In FIG. 13, the same reference numerals as those of the first to third preferred embodiments described in reference to FIGS. 1 to 12 are applied for indicating the same or similar corresponding members in this fourth preferred embodiment, so that their repetitive description will be eliminated. In the figure, the mechanical pencil according to the fourth preferred embodiment is composed of an outer cylinder 1, a tip element 2, a lead supplying cylinder 3, an extremity end receiving element 4 and a lead feeding mechanism 5. This lead feeding mechanism 5 is composed of a lead chuck 6, a sleeve 7, a front cylinder 9 fixed to the extremity end of the sleeve 7, a chuck fastening element 10 having a tapered surface 10*a*, balls 11 for use in fastening the chuck and a first resilient member 12 for relatively biasing the lead chuck 6 within the sleeve 7. Within the front cylinder 9 is arranged a projecting bar 20 which biases the slider 13 in an advancing direction by way of the second resilient member 16. The slider 13 is provided with a lead pipe 14 and a friction applying member 15 in the same manner as that of the first preferred embodiment. In FIG. 14, a connected condition of the lead chuck 6 and the sleeve 7 in the lead feeding mechanism 5 is illustrated. In this preferred embodiment, an extremity end of the extremity end receiving element 4 is projected rearwardly to become a lead chuck pushing part 41 and then inserted into the sleeve 7 at the rear end of the sleeve 7. This lead chuck pushing part 41 is constructed such that it may push a semi-circumferential flange 6*a* of the lead chuck 6.

Detailed construction of the lead chuck 6 will be described. It is different from that of the first to third preferred embodiments described above. That is, as the first feature, a stepped part 601 is projected and formed at a part near the sliding surface at the rear part of the semi-circumferential flange 6*a* and another stepped part 602 is projected and formed in a circular form at a position displaced circumferentially by a degree of 90° with respect to the stepped part 601. As a second feature, it shows a different constitution of the teeth 63 of the lead holding part 62. The teeth 63 are composed of two kinds of teeth, i.e. first teeth 63*a* holding an outer circumference of the lead S at four points in the same manner as that of the first preferred embodiment and second teeth 63*b* projected and formed across the groove bottom part of the U-shape of the lead holding part 62 alternatingly between the first teeth 63*a*.

Action and operation of the fourth preferred embodiment will be described in reference to the above-mentioned constitution. Since the description of the operation is basically the same as that of the first to third preferred embodiments, a repetitive description is eliminated and only features of the fourth preferred embodiment will be described. First, the stepped portions 601 and 602 are projected and formed across the semi-circumferential flange 6*a* of the first feature with a displacement of 90°. Only the stepped part 601 projected in a rearward direction as shown in FIG. 14 is abutted by the lead chuck pushing part 41 of the extremity end receiving element 4, and since the stepped part 602 is provided with the first resilient member 12 resiliently, each of the chuck members 61 and 61 is expanded to flex outwardly with respect to the lead S. Since the expanding operation accompanying this flexing action is carried out instantaneously, an expanding operation of the lead chuck 6 is rapidly carried out.

Figure 20:
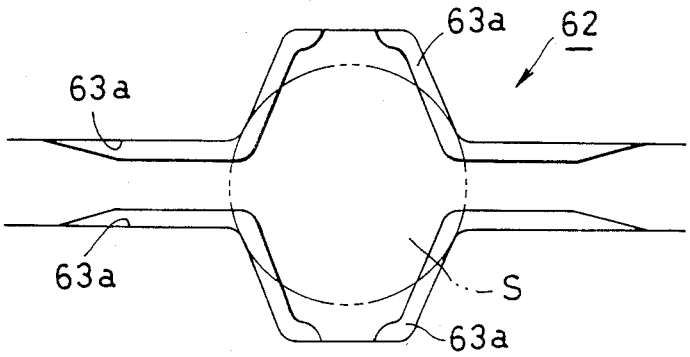
FIG. 20 is a section taken along a line F—F of FIG. 19.
Figure 21:
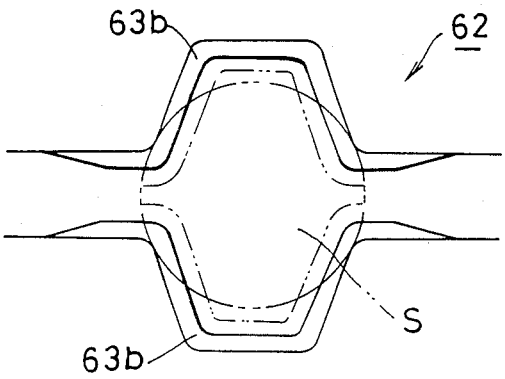
FIG. 21 is also a section taken along a line G—G of FIG. 19.
Figure 22:
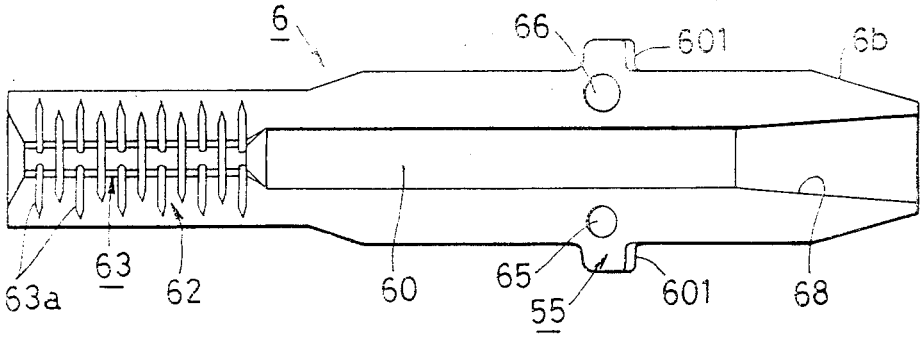
FIG. 22 is a top plan view for showing a shape of the teeth in a chuck member.

A second feature of the action of the fourth preferred embodiment will be described. In the lead feeding mechanism for performing not only the rear end knocking but also three operations such as an automatic lead feeding and a so-called extremity end knocking or the like, since the lead holding force is stronger than that of the normal mechanical pencil, the lead chuck may cut the outer circumference of the lead S and sometimes generate a so-called lead reduction state. Application of the lead chuck in the fourth preferred embodiment causes a state in which the second teeth **63*b* formed across the groove bottom of the holding part 62 may hold the lead S positively and feed the lead even upon occurrence of reduction of lead diameter caused by cutting of the four-point supporting part. In regard to the cut lead dust, since the first teeth 63*a* and the second teeth 63*b* are projected and formed alternatively, the lead dust may drop in a zig-zag fashion as the dust may transmit along the sliding surfaces spaced apart slightly as well as the groove bottom part of the lead holding part 62, i.e. the dust may drop at the extremity end such that clogging of the lead dust does not occur. FIGS. 20 and 21 show this lead holding condition, and both of these figures show that each of the teeth 63*a* and 63*b* holds the lead S. When a so-called reduction in diameter of the lead is generated, as shown in FIG. 20, the lead holding is not positively performed with only the four-point lead holding n of the first teeth 63*a*, but also as shown in FIG. 21, the second teeth 63*b*** hold the lead S at two more points.

Figure 23:
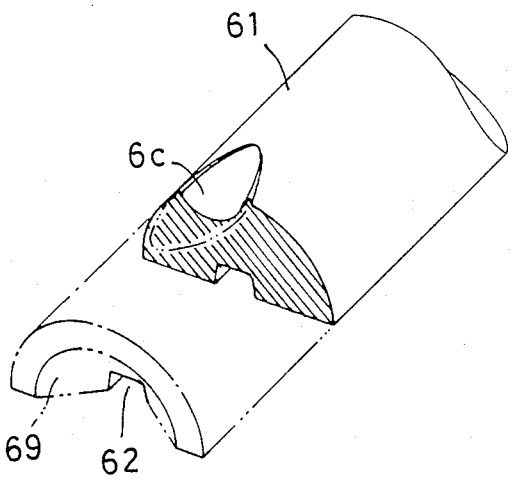
FIG. 23 is a perspective view partly in section for showing a ball holding part for a chuck member.

FIG. 23 is a perspective view for showing an enlarged state of the ball receiving portion **6*c* which is an important feature and allows for lead holding action of the chuck member 61 of the lead chuck 6** in the fourth preferred embodiment.

Figure 24:
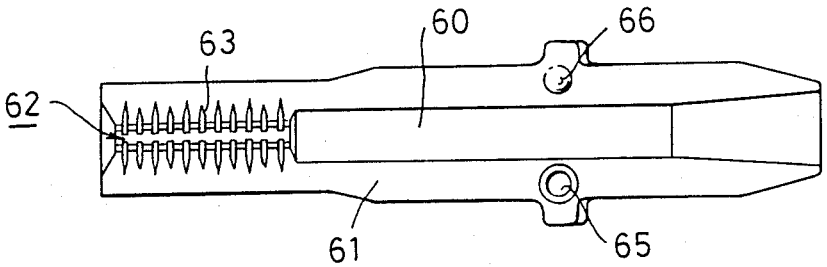
FIG. 24 is a top plan view for showing a fifth preferred embodiment of a lead chuck of a mechanical pencil of the present invention.
Figure 25:
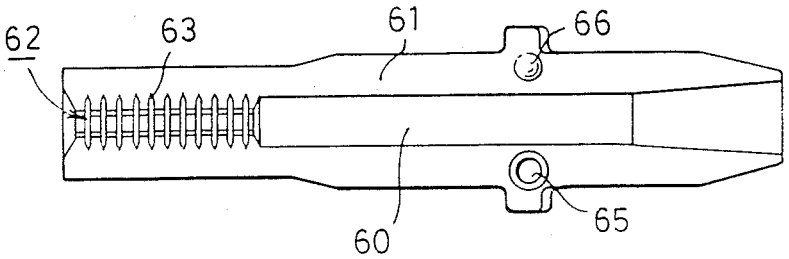
FIG. 25 is a top plan view for showing a sixth preferred embodiment of a lead chuck of a mechanical pencil of the present invention.

Although several kinds of structures of the teeth 63 are already described in the first to fourth preferred embodiments, the lead chuck of the present invention is not limited to the description of these structures and it may be constructed as shown in FIGS. 24 and 25. That is, in the fifth preferred embodiment shown in FIG. 24, the stepped portions 601 and 602, which are projected and formed across the semi-circumferential flange illustrated in the fourth preferred embodiment for applying resilient force, are combined with one kind of the teeth 63 illustrated and described in the first preferred embodiment. In a sixth preferred embodiment shown in FIG. 25, the stepped portions 601 and 602 are combined only with the second teeth **63*b*** in the fourth preferred embodiment.

Also in the fifth and six preferred embodiments having each of the above-mentioned constitutions, the basic operation of the present invention, including the resilient expanding action of the lead chuck 6 and a positive holding of lead while discharging the lead dust without accumulating the same, can be performed in the same manner as in the fourth preferred embodiment.

As described above in detail, according to the present invention, the teeth formed at the holding parts of the extremity ends at the sliding surfaces of the chuck part in the two-way divided fully separate type lead chuck are contacted with the outer circumference of the lead at four points or six points as desired by adding the second teeth. They are constructed such that the four points at the first teeth and the two points at the second teeth are alternatively arranged, and the stepped portions are projected from the extremity end and the rear end of the semi-circumferential flange which is arranged at an outer circumference of the chuck at the same axial location as the supporting points for the lead chuck expansion and are circumferentially displaced by approximately 90° as desired, so that the present invention has the following various effects.

First, since the structure of lead holding teeth of the lead chuck is such that only a small part of the outer circumference of the lead is not held, even if the mechanical pencil is used for a long period of time, it is possible to sell a lead chuck having a superior lead holding force even when the lead diameter is reduced due to the outer circumference of the lead being cut by the teeth formed at the lead holding part of each of the extremity ends of the chuck. A so-called lead reduction phenomenon can therefore be substantially prevented such that a sliding of the lead or the like is less likely.

Secondly, the above-mentioned phenomenon of reduction of lead diameter can be prevented even in the case of an automatic lead feeding type mechanical pencil or an extremity end knock type mechanical pencil or the like, as well as a rear end knock type mechanical pencil requiring an especially strong lead holding force and a positive lead feeding operation in these automatic or semi-automatic mechanical pencils. Thus, smooth writing with the mechanical pencil is promoted by preventing lead breakage.

Thirdly, even if the outer circumference of the lead is cut by the teeth formed at the above-mentioned lead holding surface and a lead reduction phenomenon occurs, the cut lead dust will not be clogged in the lead insertion hole of the lead chuck or in a space between the lead chuck and the sleeve. Thus, various smooth feeding operations such as a rear end knock, an automatic lead feeding and an extremity end knocking or the like can be performed while essentially eliminating problems encountered in lead feeding mechanisms.

Fourthly, the lead chuck is expanded to release the lead held condition such that it is resiliently expanded with a flexing force applied by the stepped portions formed at the semi-circumferential flange arranged at an outer circumference in a displacement of about 90° with respect to the supporting points. These supporting points are positioned at the sliding surfaces of the chuck part and the extremity end of the receiving element is abutted against the stepped portions at the rear end side, so that a positive, smooth and rapid expanding operation can be performed. Some disadvantages such as the lead reduction eliminated, and operability of the mechanical pencil is improved.

What is claimed is:

1. A lead chuck of a mechanical pencil in which said chuck is completely divided along a lead insertion hole into two chuck members with mutually adjacent substantially planar inner surfaces and mutually oppositely facing semi-circumferential outer surfaces, such that lead can be held therebetween by a lead holding part, disposed at a forward end of said chuck members, by which the lead is fed out by way of expansion of a rearward extremity end of said chuck upon performance of a knocking operation, the improvement comprising:

a flange projected semi-circumferentially about a rear portion of said semi-circumferential outer surface of each of said chuck members, said flange having a forward face and a rearward face;

a first stepped portion projected forwardly from said forward face of each of said semi-circumferential flanges and extending outwardly from a central portion of said semi-circumferential outer surface of each of said chuck members the same radial distance as does each said flange, for receiving a rear end of a resilient member against a front face of each of said first stepped portions of said semi-circumferential flanges;

second stepped portions, each being projected rearwardly from and formed integral with said rear face of each said semi-circumferential flange and projecting outwardly from said semi-circumferential outer surface of each said chuck member, for receiving an extremity end of a receiving element;

such that when said receiving element is pressed against said second stepped portions, said first stepped portions are pressed against a biasing force of said resilient member and cause a radially outward motion of said extremity end of each said chuck member to thereby result in expansion of said lead chuck and release of said lead.

2. A lead chuck of a mechanical pencil as set forth in claim 1 in which:

axially and longitudinally extending grooves shallower than the lead insertion hole are arranged at each of the inner surfaces of each of said chuck members, and a lead holding means is provided at corners of projected sides of said grooves for holding an outer circumference of said lead by contacting the circumference of the lead along axial lines thereof.

3. A lead chuck of a mechanical pencil as set forth in claim 2 in which;

said grooves are cut substantially in a V-shape and the bottoms of said grooves provide means for discharging lead dust out of the lead chuck.

4. A lead chuck of a mechanical pencil as set forth in claim 1, and further comprising lead holding means comprising axially and longitudinally extending grooves cut into each of the inner surfaces of each of said chuck members at the extremity ends thereof, wherein each of said grooves is shallower than said lead insertion hole, and said grooves including raised surfaces on edges thereof which comprise transverse teeth, said lead being held thereby under four-point contacted condition by abutting each of the teeth of each of said chuck members against an outer circumference of the lead from four opposing directions.

5. A lead chuck of a mechanical pencil as set forth in claim 1 further comprising a lead holding means which is comprised of;

axially and longitudinally extending shallower grooves cut and formed at the extremity ends of said inner surfaces of each of said chuck members, said grooves being cut shallower than said lead insertion hole, first teeth projected in several rows and formed to hold the outer circumference of said lead along four longitudinal lines, and second teeth formed at bottom surfaces of said grooves alternately between said first teeth and contacting said lead along longitudinal lines not contacted by said first teeth to thereby provide contact along six longitudinal lines about the circumference of said lead so as to provide sufficient holding force when the lead is reduced in its diameter due to a prolonged use of the lead chuck.

6. A lead chuck of a mechanical pencil in which a chuck member is completely divided along an axially extending lead insertion hole into two chuck segments with mutually adjacent inner surfaces and diametrically opposite semi-circumferential outer surfaces, and forms part of a lead feeding mechanism, said chuck member including a lead holding part formed at an extremity end thereof, and means for expanding said lead holding part during advancing movement of said chuck member when an extremity end of a receiving member presses said chuck member forwardly against a biasing force of a resilient member installed between said chuck member and a sleeve of said lead feeding mechanism, to perform a feeding of said lead, wherein;

said expanding means comprises;

mutually adjacent fulcrum points formed on rearward portions of said mutually adjacent inner surfaces of said chuck segments;

flanges projected semi-circumferentially about said diametrically opposite semi-circumferentially outer surfaces of said chuck segments near said fulcrum points of said chuck segments;

a first stepped projection projected forwardly from and connected with a substantially central portion of each of said semi-circumferential flanges at a position where a force exerted against said first stepped projection by said resilient member provides a substantially maximum moment about said fulcrum points;

second stepped projections, each being projected rearwardly from and connected with an end of said flanges for receiving said extremity end of said receiving member, each of said ends of each of said flanges being adjacent said inner surfaces of said chuck segments.

7. A lead chuck of a mechanical pencil as set forth in claim 6, wherein said lead holding part comprises axial longitudinal recessed grooves formed more shallow than the lead insertion holes at an extremity end in each of the inner surfaces of each of said chuck segments;

a plurality of rows of first teeth projected and formed from raised surfaces of said grooves to hold the outer periphery of said lead along four longitudinal lines; and second teeth formed at bottom surfaces of each of said grooves alternately between said first teeth and having teeth height lower than that of said first teeth so as to hold a new surface of the outer periphery of said lead not cut by said first teeth when the lead is made thin at points by prolonged use of the lead chuck.

8. A lead chuck of a mechanical pencil in which a chuck member is completely divided along a lead insertion hole into two chuck segments with mutually adjacent inner surfaces and diametrically opposite semi-circumferential outer surfaces, and forms part of a lead feeding mechanism, said chuck member including a lead holding part formed at an extremity end thereof, and means for expanding said lead holding part during advancing movement of said chuck member when an extremity end of a receiving member presses said chuck member forwardly against a biasing force of a resilient member installed between said chuck member and a sleeve of said lead feeding mechanism, to perform a feeding of said lead, wherein;

said lead holding part is constructed such that corners of raised portions positioned oppositely against both sides of a shallow groove are provided with several first lead holding teeth projected such that, when the sliding surfaces of each chuck segment are facing each other, said first teeth of one chuck segment face said first teeth of the other chuck segment as well as face corresponding first teeth on opposite corners of the same chuck segment, the first teeth are abutted against the outer periphery of the lead along four longitudinal lines thereon when said lead is gripped and the lead is held under a condition in which each lead abutment portion of the first teeth is point contacted; and second teeth raised from a bottom surface of said shallow groove and having a lower tooth height than that of said first teeth are projected and formed alternately between each of the several first teeth arranged along an axial direction of the mechanical pencil in order to hold the lead with said first teeth and to contact the outer periphery of the lead with said second teeth when said first teeth cut into the outer periphery of said lead and produce a lead thinning phenomenon during prolonged use of the same lead;

such that a new surface of the outer periphery of said lead which has not been cut by said first teeth is held by said second teeth and provides a holding force in addition to that provided by said first teeth when said lead thinning phenomenon occurs.

9. A lead chuck of a mechanical pencil as set forth in claim 8, comprising lead dust discharging means for discharging lead dust out of said chuck member both axially and radially;

said discharging means including a dust discharging part formed by a clearance formed between each of said chuck segments through which lead dust is axially guided from a central part of bottom surfaces of each of said grooves.

* * * * *